United States Patent [19]

Konrad

[11] Patent Number: 4,771,543

[45] Date of Patent: Sep. 20, 1988

[54] PATENT-DRAFTING AID

[76] Inventor: Joseph D. Konrad, 6340 Stumph Rd., Cleveland, Ohio 44130

[21] Appl. No.: 92,653

[22] Filed: Sep. 3, 1987

Related U.S. Application Data

[63] Continuation-in-part of Ser. No. 909,632, Sep. 22, 1986, abandoned.

[51] Int. Cl.[4] ..... B43L 13/00

[52] U.S. Cl. ..... 33/1 AA; 33/DIG. 1; 33/435

[58] Field of Search ..... 33/403, 430, 435, 431, 33/443, 1 K, 1 G, 1 AA, 1 B, DIG. 1, 26, 27.07; 335/285, 287, 303

[56] References Cited

U.S. PATENT DOCUMENTS

| | | | |
|---|---|---|---|
| 397,147 | 2/1889 | Sperry | 33/435 |
| 3,093,919 | 6/1963 | Holtz | 33/DIG. 1 |
| 3,456,352 | 7/1969 | Bowen | 33/430 |
| 3,618,137 | 11/1971 | Bassett | 335/285 |
| 3,721,007 | 3/1973 | Banner | 33/1 SD |
| 3,739,478 | 6/1973 | Elenberger | 33/403 |
| 4,366,626 | 1/1983 | Livick | 33/435 |
| 4,442,605 | 4/1984 | Weihe | 33/DIG. 1 |
| 4,515,077 | 5/1985 | Davidson | 33/1 B X |
| 4,536,732 | 8/1985 | Schindl | 335/285 |

FOREIGN PATENT DOCUMENTS

| | | | |
|---|---|---|---|
| 2902668 | 8/1979 | Fed. Rep. of Germany | 33/DIG. 1 |
| 399955 | 4/1966 | Switzerland | 33/DIG. 1 |
| 2073106 | 10/1981 | United Kingdom | 33/DIG. 1 |

*Primary Examiner*—Harry N. Haroian
*Attorney, Agent, or Firm*—Robert B. Henn

[57] ABSTRACT

A device for facilitating patent drafting comprises a base sheet, and a second sheet to which the drafting medium is affixed, the sheets having magnetic properties to maintain the base and second sheets in an alignable relationship with each other, the second sheet being transparent in some areas. Guidelines on the base and second sheets permit ready alignment of patent drafting requirements and to commonly used drafting angles. In one embodiment, the magnetic means are positioned to cause the sheets to maintain alignment at commonly used drafting angles.

5 Claims, 1 Drawing Sheet

PATENT-DRAFTING AID

CROSS-REFERENCE TO RELATED APPLICATION

This application is a continuation-in-part of my copending application Ser. No. 909,632, filed on Sept. 22, 1986, and now abandoned.

BACKGROUND OF THE INVENTION

1. Field of the Invention

The present invention is in the field of devices to facilitate mechanical patent drawing. More particularly, this invention is in the field of devices to facilitate drafting on sheets of the order of up to about 25 by about 40 centimeters (cm.), with indicia to guide a patent draftsman.

2. Description of the Prior Art

It is known in the art of mechanical drawing to use various aids in order to improve the draftsman's productivity. Included in such aids are my Method and Means for Centerless Circle Construction. U.S. Pat. No. 4,589,210, and Guide for Ellipse Construction, U.S. Pat. No. 4,688,220. This idea permits rapid and accurate drafting of families of concentric circles.

In other methods relating to drafting productivity, draftsmen affix the drafting medium to a base in order to work properly on the drawing. They have pinned drawing sheets to wooden boards and taped them to boards of other compositions for years. The fact of the sheet being fastened to the board, however, means that drawing some kinds of lines can be very awkward or difficult, depending on the kind of drawing and the draftsman's abilities. This circumstance lends itself only to modest drafting efficiency.

Fairly often, the draftsman finds it easier to remove the drawing from the board, make the entries necessary, and then re-affix it to the board. This procedure has obvious drawbacks, including the expenditure of time, and the inescapable possibility of misalignment when the drawing is re-affixed. None of this discussion even touches upon the difficulties of fastening the drawing during the intermediate step, which may present alignment problems of its own, or the damage to the drafting medium from repeated taping or tacking.

The modern use of specialized drafting tables has helped to alleviate the problems disucssed here, but has not completely eliminated them, and such devices are priced far beyond the economic reach of the average draftsman; the cost of a specialized table is so large that such a device is beyond the means even of smaller firms.

Devices are known which employ guidelines, such as, e.g., Ellenberger, U.S. Pat. No. 3,739,478. Other devices are known which use magnetic means to hold portions of drafting apparatus together, such as British Pat. No. 2,073,106A issued to Minnesota Mining and Manufacturing Company. However, none of the devices permit a ready alignment and realignment of the drafting medium in the course of preparing a patent drawing.

SUMMARY OF THE INVENTION

The present invention is a device for facilitating patent drafting, comprising a base sheet and a second sheet, each of the base and second sheets being magnetically removably affixed to the other, one of the sheets having a surface to which a drafting medium can be affixed. Guide lines are affixed to both of the sheets. In one embodiment, magnetic means are emplaced in the sheets to provide alignment of the sheets in the relation of commonly used drafting angles.

DESCRIPTION OF THE PREFERRED EMBODIMENTS

The preferred embodiment of the present invention comprises a plurality of sheets, wherein a base sheet is capable of being affixed to a surface such as, e.g., a drafting or other table, a second sheet formed at least partially of transparent material, the second sheet capable of being visually aligned with the base sheet, the two sheets having a capability of being magnetically affixed together and being separable one from the other. The sheets have guide lines on them for assisting the draftsman in preparing drawings in conformance with Patent and Trademark Office (PTO) guidelines. In one embodiment, the magnetic means are positioned to cause the sheets to maintain alignment at commonly used drafting angles.

The base sheet can be of a magnetic material such as, e.g., steel or plastic with a magnetically-oriented filler material. In a preferred embodiment of this invention, the magnetic domains of the base and second sheets have orientation to permit the sheets to be aligned in various attitudes typically convenient in the drafting profession, such as one sheet at 45°, 60° or 90° to the other.

Figure 1:
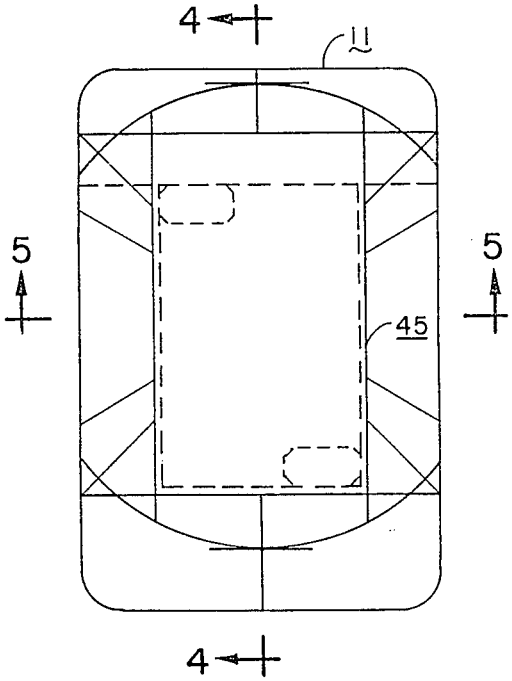
FIG. 1 is a plan view of the present invention.
Figure 4:
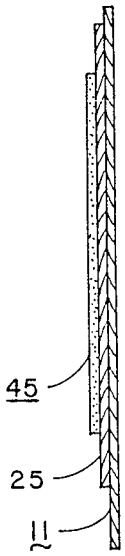
FIG. 4 is a sectional view taken along lines 4—4 of FIG. 1.
Figure 5:
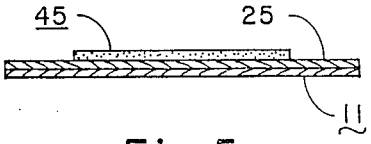
FIG. 5 is a sectional view taken along lines 5—5 of FIG. 1.
Figure 2:
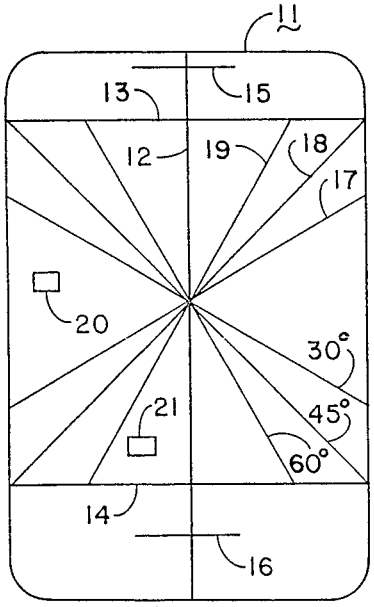
FIG. 2 is a plan view of the base sheet of the invention, showing guide lines.

Turning now to the drawings, FIGS. 1 and 2 show a view of the moieties of the invention. In FIG. 1, they are juxtaposed to illustrate the operation thereof. In FIG. 2, base sheet 11 is shown without second sheet 25 placed on it. Base sheet 11 can have magnetic characteristics, and has various indicia thereon, as more fully set forth hereinbelow. Second sheet 25 is made of any convenient material hard enough to bear pencil and pen impressions, and is similar to base sheet 11, but is smaller, and has generally arcuate top and bottom portions, as will be more fully discussed hereinbelow. Second sheet 25 is transparent at least in part, to permit the draftman to align the guidelines of the two sheets.

Base sheet 11 has magnetic characteristics and has various indicia thereon; center line 12, top guide line 13 and bottom guide line 14 serve to align the drafting medium and to facilitate drawing. Top arcuate alignment line 15 and bottom arcuate alignment line 16 function in cooperation with complementary arcuate edges 26 and 27 of second sheet 25, as more fully set forth hereinbelow with respect to second sheet 25. Angular alignment lines 17, 18 and 19 permit second sheet 25 to be set conveniently at 45°, 60° and 90° angles to base sheet 11; other common angles, such as, e.g., 15°, 30° and 75°, can be conveniently drawn by use of appropriate triangles. In one embodiment, magnetic portions 20 and 21 in base sheet 11, in interaction with magnetic portions 41 in second sheet 25, are juxtaposed to cause the two sheets to remain in substantial alignment at angles chosen for the convenience of the draftsman, generally the 45°, 60° and 90° values set forth here.

Figure 3:
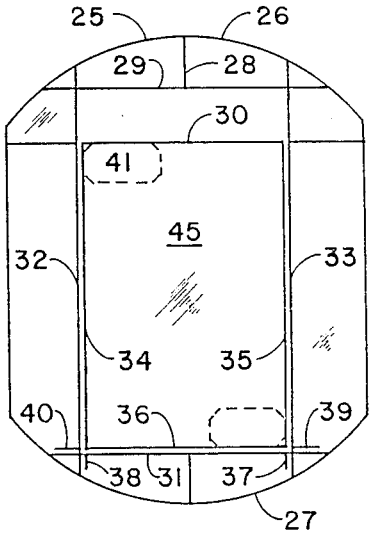
FIG. 3 is a plan view of the second sheet.

As shown in FIG. 3, and as noted hereinabove, second sheet 25 has arcuate top and bottom portion edges 26 and 27 which complement and cooperate with top and bottom arcuate alignment lines 15 and 16, respectively, of base sheet 11. Center guide line 28 aligns with center line 12 for ease of alignment in the vertical position. Top guide marginal line 29 and bottom border marginal guide line 31 permit easy alignment of the drafting medium on second sheet 25.

For patent drafting, indicia guide line 30 is useful in establishing the top of the space available for formal drawings. Bottom border marginal guideline 31, left marginal guideline 32 and right marginal guideline 33 provide for rapid alignment of the drafting medium on second sheet 25 to permit the use of the various indicia and guidelines of the invention in conformance with PTO drafting requirements.

As a further utility to patent drafting, left, right and bottom marginal lines 34, 35 and 36 respectively serve a function similar to that of indicia guide line 30, permitting the patent draftsman to determine the available sight space without having to draw such lines on the medium, or continual resort to a ruler. Thus, this invention serves to improve the net efficiency of the patent draftsman.

Extensions of lines 34, 35 and 36 appear as lines 37, 38, 39 and 40, which are respectively right bottom inside, left bottom inside, right bottom ouside and left bottom outside marginal lines. These lines permit the draftsman to draw the sight lines required in patent drawings.

In view of the foregoing discussion, FIGS. 1, 2, 4 and 5 are seen to illustrate an embodiment of the operation of the present invention. The draftsman affixes a piece of drafting medium 45 to second sheet 25 in any convenient manner, such as, e.g., masking tape or the like, aligning the medium 45 with second sheet 25 by means of bottom, left and right marginal guide lines 31, 32 and 33. As noted, the spacing of these lines is chosen to conform with PTO guidelines for drafting. Base sheet 11 is conveniently affixed to a table or other convenient surface, not shown, by means well known to those skilled in the art, neither illustrated herein nor claimed as inventive. The draftsman then places second sheet 25 on base sheet 11, aligning center line 12 and center guide line 28, and top guide line 13 on base sheet 11 with top marginal guide line 29 on second sheet 25. An additional verification of the alignment of the system can be obtained with arcuate top and bottom edges 26 and 27 juxtaposed with top and bottom arcuate alignment lines 15 and 16. In this fashion, drafting medium 45 is now aligned with a plurality of lines on both sheets 11 and 25. In the event that a line of a commonly encountered angle is required, such as, e.g., a 60° line, the draftsman can turn second sheet 25 to align the center guide line 28 with angle alignment line 19 of base sheet 11, and draw the appropriate lines. In order to draw angular axes, the draftsman can conveniently adjust second sheet 25, which is transparent material with vertical axis 28 inscribed thereon, with respect to base sheet 11. Vertical axis 28 is relocated in one of three angular axes to draw 30°, 45° and 60° lines 17, 18 and 19 respectively, to the left or right of vertical axis 28. In so moving second sheet 25 relative to base sheet 11, the alignment of the drafting medium 45 with second sheet 25 is undisturbed, and the alignment of second sheet 25 is easily restablished with base sheet 11. After any relative movement of sheets 11 and 25, magnets 20, 21 and 41 maintain the sheets relatively fixed one to another in aligned juxtaposition.

Referring to FIG. 3, it will be noted that each point on the arcuate portions 26 and 27 is equidistant from the center point of second sheet 25. Because of this construction, the end points of center guide line 28 can be aligned with each of the lines 17, 18 and 19 to provide the requisite angle.

Second sheet 25 can be made at least in part of a transparent material, permitting the draftsman a further visual check on alignment, or a guideline for a particular desired angle. By use of the extension indicia 37, 38, 39 and 40, the draftsman can draw lines within the permitted area without continual need to resort to external measuring devices, thus additionally effecting a saving in time.

In another embodiment of the present invention, sheets 11 and 25 can be made entirely of magnetic material such as, e.g., poly(vinyl chloride) with a magnetic filler, the magnetic domains arranged such that their juxtaposition provides attraction of sheets 11 and 25, and alignment in the desired 30°, 45° and 60° angular attitudes as well.

Modifications, changes and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited only by the advance by which the invention has promoted the art.

I claim:

1. An improved device for facilitating patent drafting, comprising a base sheet and a second sheet having magnetic domains, said second sheet being transparent in at least a plurality of areas and having a surface to which a drafting medium can be affixed, said base and second sheets having guide lines and indicia for patent drafting emplaced thereon, said magnetic domains being disposed to permit alignment of said sheets at predetermined angular juxtapositions.

2. The device of claim 1 wherein said magnetic domains are disposed to permit alignment of said sheets at 45°, 60° and 90° angles to each other.

3. The device of claim 1 wherein at least one of said sheets has patent-drafting guidelines thereon.

4. The device of claim 1 wherein said second sheet has an arcuate top and bottom edge.

5. The device of claim 1 wherein said base sheet has guidelines complementary with said arcuate top and bottom edges of said second sheet.

* * * * *